US008467693B2

(12) United States Patent
Higuchi et al.

(10) Patent No.: US 8,467,693 B2
(45) Date of Patent: Jun. 18, 2013

(54) IMAGE FORMING APPARATUS

(75) Inventors: Shugo Higuchi, Inagi (JP); Hideki Kubo, Kawasaki (JP); Mizue Morishita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/546,242

(22) Filed: Jul. 11, 2012

(65) Prior Publication Data

US 2012/0275801 A1 Nov. 1, 2012

Related U.S. Application Data

(63) Continuation of application No. 12/181,627, filed on Jul. 29, 2008, now Pat. No. 8,238,772.

(30) Foreign Application Priority Data

Aug. 29, 2007 (JP) ..... 2007-223088

(51) Int. Cl.
*G03G 15/10* (2006.01)

(52) U.S. Cl.
USPC ..... 399/59; 399/58

(58) Field of Classification Search
USPC ..... 399/49, 58–65
See application file for complete search history.

(56) References Cited

U.S. PATENT DOCUMENTS

| | | | |
|---|---|---|---|
| 7,245,842 | B2 | 7/2007 | Hino |
| 2005/0185203 | A1 | 8/2005 | Oki |
| 2006/0140650 | A1 | 6/2006 | Yokote |
| 2006/0233561 | A1 | 10/2006 | Yamaoka |

FOREIGN PATENT DOCUMENTS

| | | | |
|---|---|---|---|
| JP | 9-160452 | A | 6/1997 |
| JP | 11-15255 | A | 1/1999 |
| JP | 2000-267517 | A | 9/2000 |
| JP | 2003-337455 | A | 11/2003 |
| JP | 2004-177928 | A | 6/2004 |
| JP | 2005-157100 | A | 6/2005 |
| JP | 2005-250311 | A | 9/2005 |
| JP | 2006-65124 | A | 3/2006 |
| JP | 2006-154371 | A | 6/2006 |

OTHER PUBLICATIONS

Machine translation of JP 2006-154371 obtained on Mar. 31, 2011.*
Office Action dated Nov. 23, 2009, in Korean Application No. 9-5-2009-048095034.
Office Action dated Mar. 5, 2012, in Japanese Application No. 2007-223088.

* cited by examiner

*Primary Examiner* — David Gray
*Assistant Examiner* — Gregory H Curran
(74) *Attorney, Agent, or Firm* — Fitzpatrick, Cella, Harper & Scinto

(57) ABSTRACT

An image forming apparatus which forms an electrostatic latent image on a photosensitive drum, serving as an image carrier, develops the image using toners of a plurality of colors, and transfers a toner image onto a printing medium in accordance with an electrophotographic process. A toner consumption amount detection unit detects the toner consumption amount of each of the toners of the plurality of colors, a decision unit decides upon a color to form a patch, based on input image data and the detected toner consumption amount of each color, a patch sensor detects the density of a patch of the decided color by generating the patch at a predetermined position on the photosensitive drum serving as an image carrier outside an area to form a color image, and an adjustment unit adjusts the printing density based on the detected patch density.

8 Claims, 5 Drawing Sheets

IMAGE FORMING APPARATUS

This application is a continuation of U.S. application Ser. No. 12/181,627, filed Jul. 29, 2008, which claims the benefit of Japanese Patent Application No. 2007-223088, filed August 29, 2007, both of which are hereby incorporated by reference herein in their entirety.

BACKGROUND OF THE INVENTION

1. Field of the Invention

The present invention relates to an image forming apparatus having an image carrier, such as a photosensitive drum, or the like.

2. Description of the Related Art

An electrophotographic image forming apparatus, such as a color copier using color toners of a plurality of colors, has a lookup table for converting an image signal into a signal value suitable for the engine characteristics, so as to obtain desired tone characteristics. In a color copier, this lookup table is provided for each color of yellow, magenta, cyan, and black, and control is done to optimize the color component of each color so as to be able to output a desired full-color image. In an electrophotographic system, however, even when image forming conditions do not change, its characteristics easily change depending on the ambient circumstances, use situation, or the like. Therefore, it is difficult to continuously output images with a stable tint. To solve this problem, a technique is available which detects the density of a toner image formed on a transfer material, such as a printing sheet, or an image carrier, such as a photosensitive drum, and controls image forming conditions based on the obtained information, so as to obtain desired tone characteristics. For example, Japanese Patent Laid-Open Nos. 2005-157100 (reference 1) and 2003-337455 (reference 2) disclose a technique of correcting a lookup table and a technique of changing the charge condition or development condition of a photosensitive drum on which an electrostatic latent image is formed.

In a conventional image forming apparatus, however, since patches to be formed on an image carrier, such as a photosensitive drum, are uniquely determined, a patch for a stable toner color, which need not be corrected, is also formed, consuming toner excessively. In addition, calibration requires extra time.

SUMMARY OF THE INVENTION

Accordingly, the present invention can reduce a toner consumption amount as well as to shorten the time required for calibration.

According to one aspect of the present invention, an image forming apparatus is provided, which forms a color image by using a plurality of color toners in accordance with an electrophotographic process, the apparatus including a toner consumption amount detection unit that detects a toner consumption amount of each of the plurality of color toners; a decision unit that decides upon a color for forming a patch based on input image data and the detected toner consumption amount of each of the plurality of color toners; a forming unit that forms the patch, by using a toner of the decided color, outside of an area to form a color image in accordance with the input image data; a patch density detection unit that detects a density of the formed patch; and an adjustment unit that adjusts a printing density based on the detected density of the formed patch.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

A preferred embodiment of the present invention will now be described in detail with reference to the accompanying drawings.

[System Arrangement]

Figure 1A:
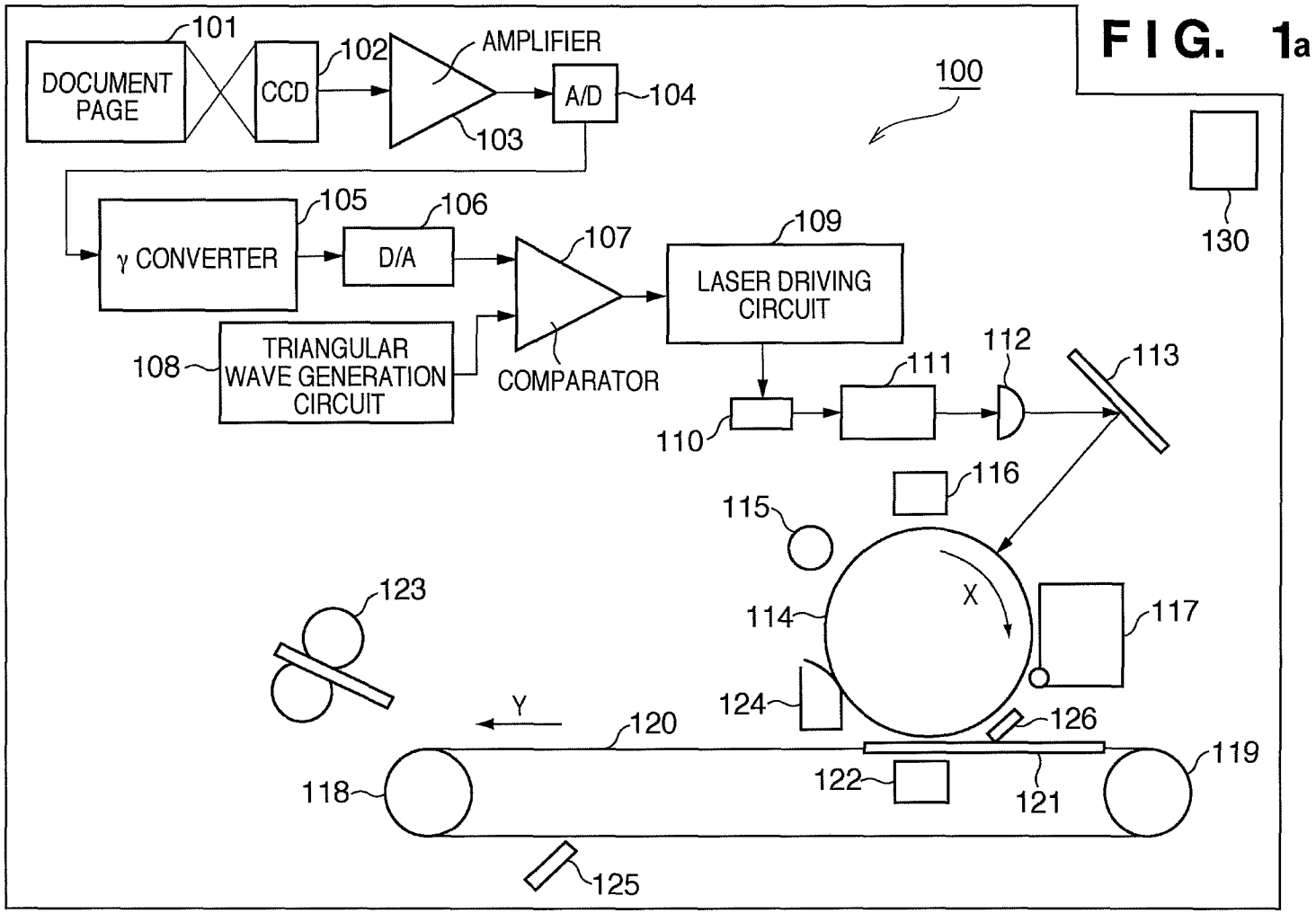
FIG. 1*a* is a functional block diagram showing the system arrangement of an image forming apparatus 100 according to an embodiment with a single image forming station.
Figure 1B:
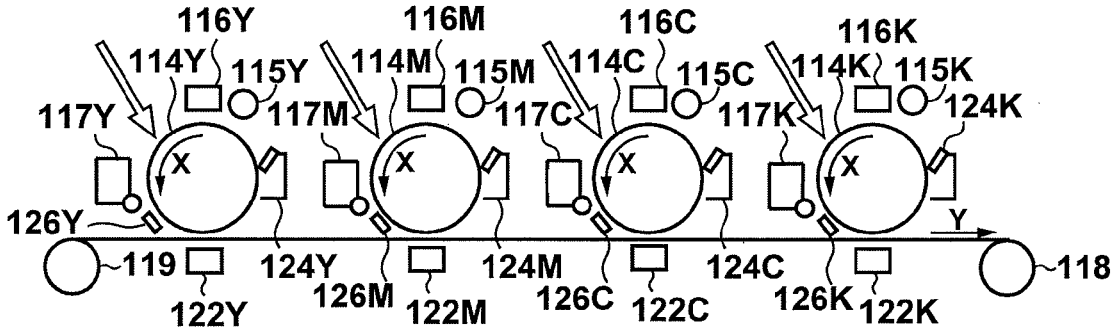
FIG. 1*b* is a block diagram showing image forming stations for the colors of yellow, magenta, cyan, and black of an image forming apparatus.

FIG. 1*a* is a functional block diagram showing the system arrangement of an image forming apparatus 100 according to an embodiment with a single image forming station. The image forming apparatus 100 forms an electrostatic latent image on an image carrier, develops the image using toners of a plurality of colors (as shown in FIG. 1*b*), and transfers the toner image onto a printing medium in accordance with an electrophotographic process.

First, the image forming apparatus 100 reads a document page 101 as an image from a CCD 102 via an imaging lens. The CCD 102 decomposes the image into a large number of pixels and generates a photoelectric conversion signal (analog image signal) corresponding to the density of each pixel. The obtained analog image signal is amplified to a predetermined level by an amplifier 103 and converted by an analog/digital converter (A/D converter) 104 into, for example, an 8-bit (256-tone) digital image signal.

Then, the digital image signal is supplied to a y converter (in this embodiment, a converter which includes data of 256 bytes and executes density conversion based on a lookup table) 105. After the γ correction, the digital image signal is input to a digital/analog converter (D/A converter) 106. In the D/A converter 106, the digital image signal is converted into an analog image signal again and input to one of two inputs of a comparator 107.

A triangular wave signal having a predetermined period, which is generated from a triangular wave generation circuit 108, is input to the other input of the comparator 107. The analog image signal converted by the D/A converter 106 is compared with this triangular wave signal and undergoes pulse width modulation. The binary image signal, which underwent the pulse width modulation, is input to a laser driving circuit 109 and used as an ON/OFF control signal for controlling light emission/no-light emission of a laser diode 110.

The laser light emitted from the laser diode 110 is scanned by a known polygon mirror 111 in the main scanning direction, passes through an fθ lens 112 and a reflection mirror 113, and is guided to become incident on a photosensitive drum 114, serving as an image carrier, which rotates in the direction indicated by an arrow X, thereby forming an electrostatic latent image.

On the other hand, the photosensitive drum 114 is uniformly charge-removed by an exposure unit 115, and then uniformly charged (for example, negatively charged) by a primary charger 116. After that, the laser light emitted from the laser diode 110 is applied on the photosensitive drum 114, thereby forming an electrostatic latent image corresponding to the image signal.

This electrostatic latent image is developed into a visible image (toner image) by a developer 117. At this time, a DC bias component corresponding to the formation condition of the electrostatic latent image and an AC bias component for improving the developing efficiency are superimposed and applied to the developer 117.

This toner image is transferred by the action of a transfer charger 122 onto a transfer material 121 held on a belt-like transfer material carrier (transfer belt) 120, which extends between two rollers 118 and 119, and is endlessly driven in the direction indicated by an arrow Y. The image is fixed on the transfer material 121 through a fixing unit 123, and the transfer material 121 is delivered to the outside of the apparatus main body.

The residual toner on the photosensitive drum 114 is scraped off and recovered by a cleaner 124. After the transfer material 121 is separated, the residual toner on the transfer belt 120 is scraped off by a cleaner 125 (e.g., a blade, or the like) provided in the periphery of the transfer belt 120 and downstream of the position at which the transfer material 121 is passed to the fixing unit 123.

Only a single image forming station is shown and described in FIG. la. When an image forming apparatus (including the photosensitive drum 114, exposure unit 115, primary charger 116, developer 117, and the like), which forms a color image, is used, image forming stations corresponding to respective colors of, for example, yellow, magenta, cyan, and black, can be arranged as follows. For example, FIG. 1*b* shows image forming stations may be sequentially arranged on the transfer belt 120 along the movement direction Y of a transfer material. FIG. 1*b* is a block diagram of an image forming apparatus including four image forming stations. The image forming station for yellow toner includes photosensitive drum 114Y, exposure unit 115Y, primary charger 116Y, developer 117Y, transfer charger 122Y, cleaner 124Y, and patch sensor 126Y; the image forming station for magenta toner includes photosensitive drum 114M, exposure unit 115M, primary charger 116M, developer 117M, transfer charger 122M, cleaner 124M, and patch sensor 126M; the image forming station for cyan toner includes photosensitive drum 114C, exposure unit 115C, primary charger 116C, developer 117C, transfer charger 122C, cleaner 124C, and patch sensor 126C; and the image forming station for black toner includes photosensitive drum 114K, exposure unit 115K, primary charger 116K, developer 117K, transfer charger 122K, cleaner 124K, and patch sensor 126K. In an alternative arrangement, the developers 117Y, 117M, 117C, and 117K for respective colors may be arranged along the periphery of a photosensitive drum 114. Alternatively, the developers 117Y, 117M, 117C, and 117K for respective colors of yellow, magenta, cyan, and black may be arranged in a rotatable housing. With this arrangement, it is possible to bring the desired developer 117 to face the photosensitive drum 114 to develop a desired color.

In addition, a patch sensor 126 (density detection means), which detects a patch density, is provided at a position on the surface of the photosensitive drum 114 where the photosensitive drum 114 faces the transfer belt 120 in the rotation direction of the photosensitive drum 114. The patch sensor 126 detects the density of a toner image (patch) for density detection, which is developed on the photosensitive drum 114. The concentration of a developing agent of the developer 117, that is, the toner amount, is controlled so as to keep the patch image density constant. With this arrangement, it is possible to correct the toner concentration in the developer 117, which has changed due to development of a latent image.

Figure 2:
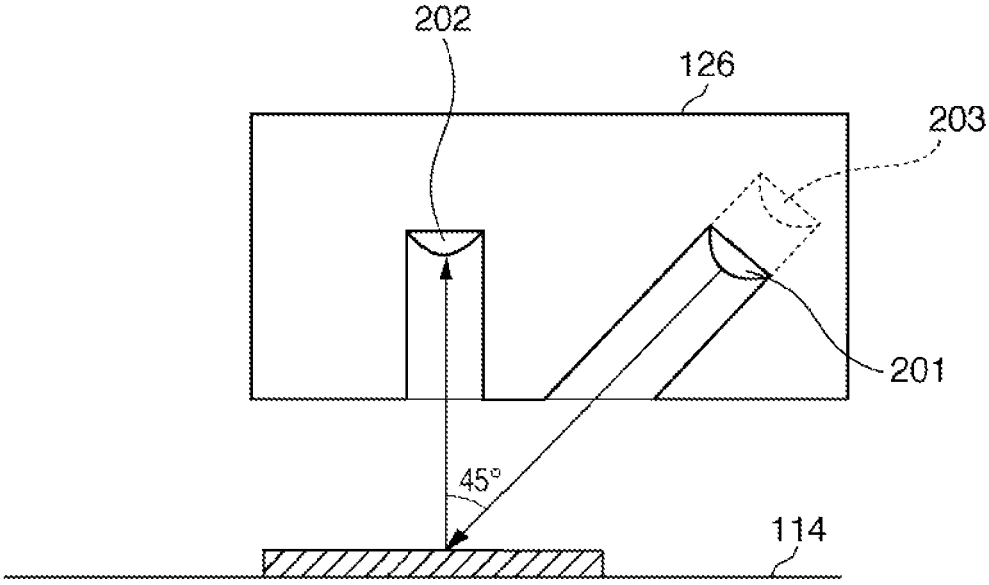
FIG. 2 is a schematic sectional view showing a patch sensor 126 according to an embodiment.

FIG. 2 is a schematic sectional view showing an example of the patch sensor 126. The patch sensor 126 comprises a light source 201, a photosensor 202 for density detection, which receives light emitted from the light source 201 toward a patch and reflected by it, and a photosensor 203 for light amount adjustment, which directly receives light from the light source 201 in order to keep the light amount from the light source 201 constant. An LED, for example, or the like, may be used for the light source 201.

More specifically, the patch sensor 126 detects the development density of the patch-like visible image (to be referred to as a patch, hereinafter) for density detection, which is obtained by developing an electrostatic latent image formed by an image signal for density control, and calculates a correction density signal. Based on the calculated correction density signal, a lookup table held by the γ converter 105 is newly generated or corrected to maintain desired tone characteristics.

This sequence of operations is controlled by a controller 130, including a CPU, which executes a control process, a ROM, which stores a control program, and a RAM, which temporarily stores a program or data.

[General Operation Procedure of Image Forming Process]

Figure 3:
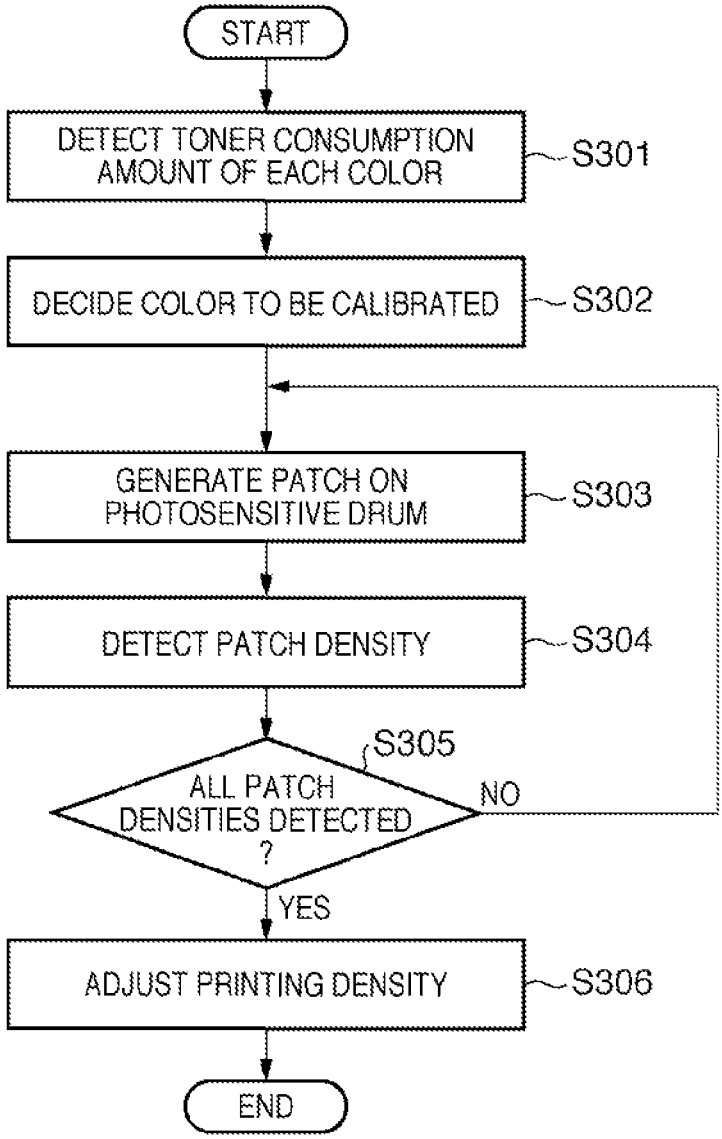
FIG. 3 is a flowchart illustrating the operation procedure of an image forming process according to an embodiment.

FIG. 3 is a flowchart illustrating the operation procedure of an image forming process according to an embodiment. First, the toner consumption amounts of the respective toners of a plurality of colors, that is, ΔC (cyan consumption amount), ΔM (magenta consumption amount), ΔY (yellow consumption amount), and ΔK (black consumption amount), are detected (step S301). Next, a color to be calibrated is decided based on the detected toner consumption amount of each color (step S302), and a patch of the color decided in step S302 is generated at a predetermined position on the photosensitive drum (image carrier) (step S303). Note that the detailed processing in steps S301 to S303 will be described later.

The patch sensor 126 detects the density of the patch formed in step S303 (patch density detection) (step S304). After that, whether the patch densities of all the colors decided in step S302 have been detected or not is determined (step S305). If NO in step S305, the process returns to step S303 and any remaining patches are sequentially generated. On the other hand, when YES in step S305, the printing density of the color decided in step S302 is adjusted based on the detected patch density (step S306). More specifically, after a correction density signal is calculated, a lookup table held by the γ converter is newly generated based on the calculated correction density signal.

[Toner Consumption Amount Detection Processing (step S301)]

First, an input image is analyzed to calculate dot counts (Dc (cyan), Dm (magenta), Dy (yellow), and Dk (black)) of the respective toner colors included in the image data. They can be calculated by, for example, accumulating the output levels of the pixels of a digital signal obtained by converting an image signal by the A/D converter 104. After that, the calculated dot counts of the respective toner colors are stored in the RAM, or the like.

The dot counts Dc, Dm, Dy, and Dk, included in each image, are multiplied by constants Cc, Cm, Cy, and Ck, respectively, and the obtained value is added to the (n-1)th toner consumption amount. That is, the nth toner consumption amounts $\Delta C_n$, $\Delta M_n$, $\Delta Y_n$, and $\Delta K_n$ are calculated by equations given below.

$$\Delta C_n = \Delta C_{n-1} + Cc \times Dc;$$

$$\Delta M_n = \Delta M_{n-1} + Cm \times Dm;$$

$$\Delta Y_n = \Delta Y_{n-1} + Cy \times Dky; \text{ and}$$

$$\Delta K_n = \Delta K_{n-1} + Ck \times Dk.$$

Note that the constants Cc, Cm, Cy, and Ck can be calculated by image analysis. It is assumed that the (n-1)th toner consumption amounts $\Delta C_{n-1}$, $\Delta M_{n-1}$, $\Delta Y_{n-1}$, and $\Delta K_{n-1}$ are stored in the RAM, or the like. Note also that, when the corresponding color to be calibrated is decided, each of the toner consumption amounts ΔC, ΔM, ΔY, and ΔK is reset to zero by the patch decision processing to be described below.

In this embodiment, each of the constants Cc, Cm, Cy, and Ck can be determined for each toner, and it can be changed every time, based on an input image. That is, a toner consumption amount may be detected based on the density of an input image. For example, in the case of a graphics image, in which tone, such as gradation, is considered to be important, the constants are increased. In contrast, in the case of an image, such as a landscape image, in which photographic expression is considered to be important, the constants are decreased. With this arrangement, it is possible to control the calibration frequency or a color, such as cyan, whose stability is considered to be important. It is also possible to simply calculate a constant as an average toner consumption amount per dot.

The toner consumption amount may be detected based on the size of an input image. That is, the formation number of input images may be stored in the RAM, and the constants Cc, Cm, Cy, and Ck may be calculated based on the number of output images. In addition, the toner consumption amount may be detected by providing an optical sensor in each of the toner developers 117 and optically detecting the toner consumption amount.

[Patch Decision Processing (step S302)]

First, it is determined whether the toner consumption amounts ΔC, ΔM, ΔY, and ΔK, calculated by the above-described toner consumption amount calculation processing, are larger than preset toner thresholds Lc, Lm, Ly, and Lk, respectively.

Each toner threshold may be a predetermined value, or may be a value which is changed in accordance with an input image. For example, in the case of a graphics image in which tone, such as gradation, is considered to be important, the threshold of a certain color toner can be decreased.

When the toner consumption amount is determined to be larger than the corresponding toner threshold, a patch including that toner is decided for calibration. A patch to be decided is obtained by outputting target toner at a given density.

In this processing, a color with a small toner consumption amount ΔC, ΔM, ΔY, or ΔK can be considered to have a relatively small change in characteristics, since the accumulated time in which it underwent a developing operation is probably short. For this reason, the color of the toner, whose consumption amount detected in step S301, is determined to be larger than the threshold, is determined to be a color to be calibrated. On the other hand, the color of the toner whose consumption amount detected in step S301 is determined to be equal to or less than the threshold is determined to be a color not to be calibrated.

Accordingly, in step S302, patches of a plurality of colors with different tones can be determined to be colors to be calibrated, or can be colors not to be calibrated.

[Patch Formation Processing (step S303)]

Figure 4:
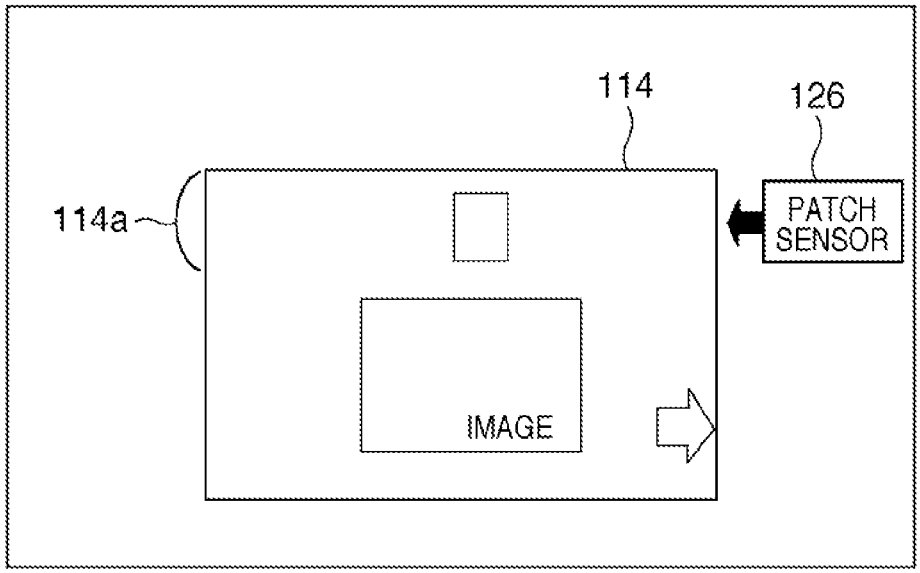
FIGS. 4 and 5 are views schematically showing the operation procedure of patch formation processing according to an embodiment.
Figure 5:
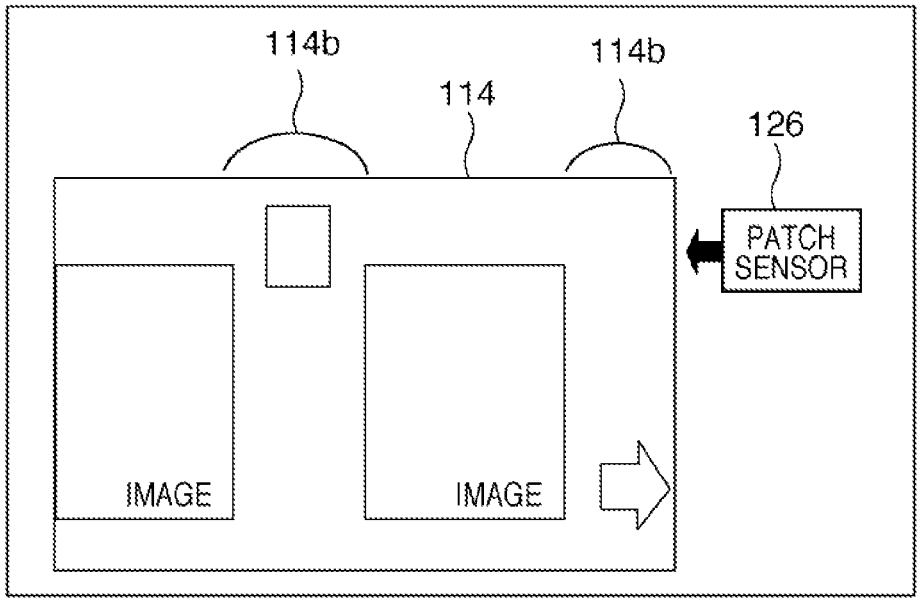

FIGS. 4 and 5 are views schematically showing the operation procedure of patch formation processing according to an embodiment. As shown in FIG. 4, when the size of an output image is small, a patch formation area can be reserved on an area 114*a* in the end portion of the photosensitive drum 114. Accordingly, it is possible to simultaneously form an image and patch on the photosensitive drum by compositing them. In the formed area, the image portion is transferred onto a transfer material, such as a printing sheet, and the patch portion is wiped out by the cleaner after its density is detected by the patch sensor.

As shown in FIG. 5, when the size of an output image is large, a patch formation area is reserved in an area 114*b* between image areas formed on the photosensitive drum, and a patch is formed in this area. In the formed area, the image portion is transferred onto a transfer material, such as a printing sheet, and the patch portion is wiped out by the cleaner after its density is detected by the patch sensor.

Accordingly, as shown in FIGS. 4 and 5, the predetermined position in step S303 means the area which falls outside the formation area of an electrostatic latent image based on an image to be printed, which is externally input.

As has been described above, according to this embodiment, since a patch is formed only for toner of a color which has been consumed by a certain amount, or more, it is possible to reduce the toner consumption amount required for calibration, as well as to shorten the time required for calibration. In addition, since image formation and calibration can be performed simultaneously, the calibration time can be further shortened.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus which forms a color image by using a plurality of color toners in accordance with an electrophotographic process, the apparatus comprising:

a toner consumption amount detection unit that detects a toner consumption amount of each of the plurality of color toners;

a decision unit that decides upon a color for forming a patch based on a type of input image data and the detected toner consumption amount of each of the plurality of color toners;

a forming unit that forms the patch, by using a toner of the decided color, outside of an area to form a color image in accordance with the input image data;

a patch density detection unit that detects a density of the formed patch; and an adjustment unit that adjusts a printing density based on the detected density of the formed patch.

2. The apparatus according to claim 1, wherein the decision unit decides upon a color for a graphic image type.

3. The apparatus according to claim 1, wherein the decision unit decides upon a color in which tone is considered to be an important type.

4. The apparatus according to claim 3, wherein the tone is gradation.

5. The apparatus according to claim 1, wherein the toner consumption amount detection unit detects the toner consumption amount based on the input image data.

6. The apparatus according to claim 1, wherein the toner consumption amount detection unit detects the toner consumption amount based on a size of an input image indicated by the input image data.

7. The apparatus according to claim 1, wherein the forming unit forms the patch in an area between a plurality of color images formed on an image carrier.

8. The apparatus according to claim 1, wherein when the area to form the color image is small, the forming unit forms the patch at an end portion of a photosensitive drum, and wherein when the area to form the color image is large, the forming unit forms the patch in a patch formation area which has been reserved before forming the color image.

* * * * *